US009236654B2

(12) United States Patent
Okano

(10) Patent No.: US 9,236,654 B2
(45) Date of Patent: Jan. 12, 2016

(54) RADIO COMMUNICATION APPARATUS WITH BUILT-IN ANTENNA

(71) Applicant: Kabushiki Kaisha Toshiba, Tokyo (JP)

(72) Inventor: Motochika Okano, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 231 days.

(21) Appl. No.: 13/773,233

(22) Filed: Feb. 21, 2013

(65) Prior Publication Data

US 2013/0321238 A1 Dec. 5, 2013

(30) Foreign Application Priority Data

May 31, 2012 (JP) ..... 2012-125243

(51) Int. Cl.
*H01Q 1/38* (2006.01)
*H01Q 1/22* (2006.01)
*H01Q 9/42* (2006.01)

(52) U.S. Cl.
CPC ..... *H01Q 1/38* (2013.01); *H01Q 1/2275* (2013.01); *H01Q 9/42* (2013.01)

(58) Field of Classification Search
CPC ..... H01Q 1/38
USPC ..... 343/700 MS, 702, 873
See application file for complete search history.

(56) References Cited

U.S. PATENT DOCUMENTS

| | | | | |
|---|---|---|---|---|
| 4,673,363 | A * | 6/1987 | Hudson et al. | 441/1 |
| 6,999,793 | B2 | 2/2006 | Jinushi | |
| 7,135,782 | B2 * | 11/2006 | Nishikawa | 257/796 |
| 8,587,485 | B2 * | 11/2013 | Tahk et al. | 343/702 |
| 8,872,621 | B2 * | 10/2014 | Miura et al. | 340/5.72 |
| 2009/0040128 | A1 * | 2/2009 | Sung et al. | 343/873 |
| 2010/0164814 | A1 | 7/2010 | Imamura | |
| 2010/0265648 | A1 | 10/2010 | Hirabayashi | |
| 2011/0316754 | A1 * | 12/2011 | Nam et al. | 343/702 |
| 2012/0303105 | A1 * | 11/2012 | Askarinya et al. | 607/116 |

FOREIGN PATENT DOCUMENTS

| | | | | |
|---|---|---|---|---|
| JP | 08186430 | A * | 7/1996 | H01Q 13/08 |
| JP | 2002-341965 | | 11/2002 | |
| JP | 2010-154469 | | 7/2010 | |
| JP | 2010-256973 | | 11/2010 | |
| JP | 2011-193244 | | 9/2011 | |

* cited by examiner

*Primary Examiner* — Tho G Phan
(74) *Attorney, Agent, or Firm* — Blakely Sokoloff Taylor & Zafman LLP

(57) ABSTRACT

According to one embodiment, the radio communication apparatus has a printed-wiring board, an electronic element, a first electrode, a second electrode, an antenna, and a molded member. The first electrode is conductor-connected to the printed-wiring board. The second electrode has the same size as the first electrode, is disposed parallel to the first electrode, and capacitively coupled to the first electrode. The molded member buries the printed-wiring board, the electronic element, the first electrode, the second electrode, and the antenna.

14 Claims, 14 Drawing Sheets

RADIO COMMUNICATION APPARATUS WITH BUILT-IN ANTENNA

CROSS-REFERENCE TO RELATED APPLICATIONS

This application is based upon and claims the benefit of priority from Japanese Patent Application No. 2012-125243, filed May 31, 2012, the entire contents of which are incorporated herein by reference.

FIELD

Embodiments described herein relate generally to a radio communication apparatus including a capacitively coupled antenna.

BACKGROUND

There is a radio communication apparatus provided with an exterior case having an inner cavity and a circuit board stored in the inner cavity and including a first high-frequency circuit and a second high-frequency circuit. In the exterior case, a first antenna electrode and a second antenna electrode are arranged on a pair of opposed inner walls. The first high-frequency circuit has a first coupling electrode disposed to face the first antenna electrode and electromagnetically coupled to the first antenna electrode. The second high-frequency circuit has a second coupling electrode disposed to face the second antenna electrode and electromagnetically coupled to the second antenna electrode.

With the miniaturization of a portable electronic equipment, the standard of radio communication of the electronic equipment is diversified. Although the latest model can be manufactured corresponding to each of various standards of radio communication, the electronic equipment does not always correspond to all standards of radio communication. In order to utilize unsupported radio communication standard, the function is compensated by an extension component. In a portable electronic equipment, a room provided for mounting the extension component is limited. Accordingly, a small radio communication apparatuses storable in the limited room is required. However, the communication performance should not be reduced by mounting the radio communication apparatus inside the electronic equipment.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, a radio communication apparatus downsized without losing communication performance is provided. The radio communication apparatus according to one embodiment is provided with a printed-wiring board, an electronic element, a first electrode, a second electrode, an antenna, and a molded member. The electronic element is mounted on the printed-wiring board and is included at least a portion of a communication circuit. The first electrode is conductor-connected to the printed-wiring board. The second electrode has the same size as the first electrode, is disposed parallel to the first electrode, and capacitively coupled to the first electrode. The antenna is conductor-connected to the second electrode. The molded member buries the printed-wiring board, the electronic element, the first electrode, the second electrode, and the antenna. The molded member is formed by injection-molding arranging the antenna near the outer surface.

Figure 1:
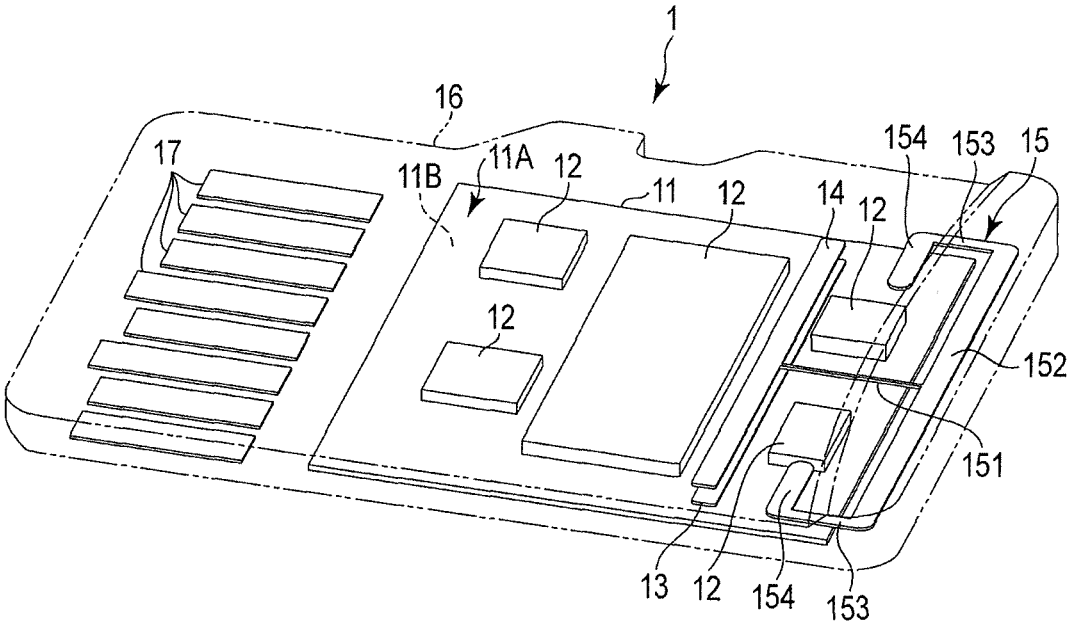
FIG. 1 is a perspective view of a radio communication apparatus of a first embodiment.
Figure 2:
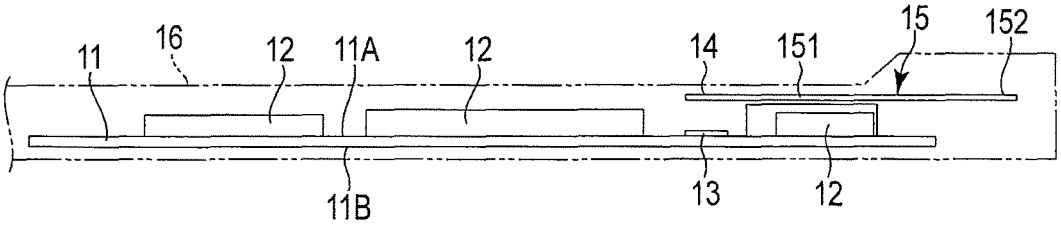
FIG. 2 is a cross-sectional view of the radio communication apparatus of FIG. 1.
Figure 3:
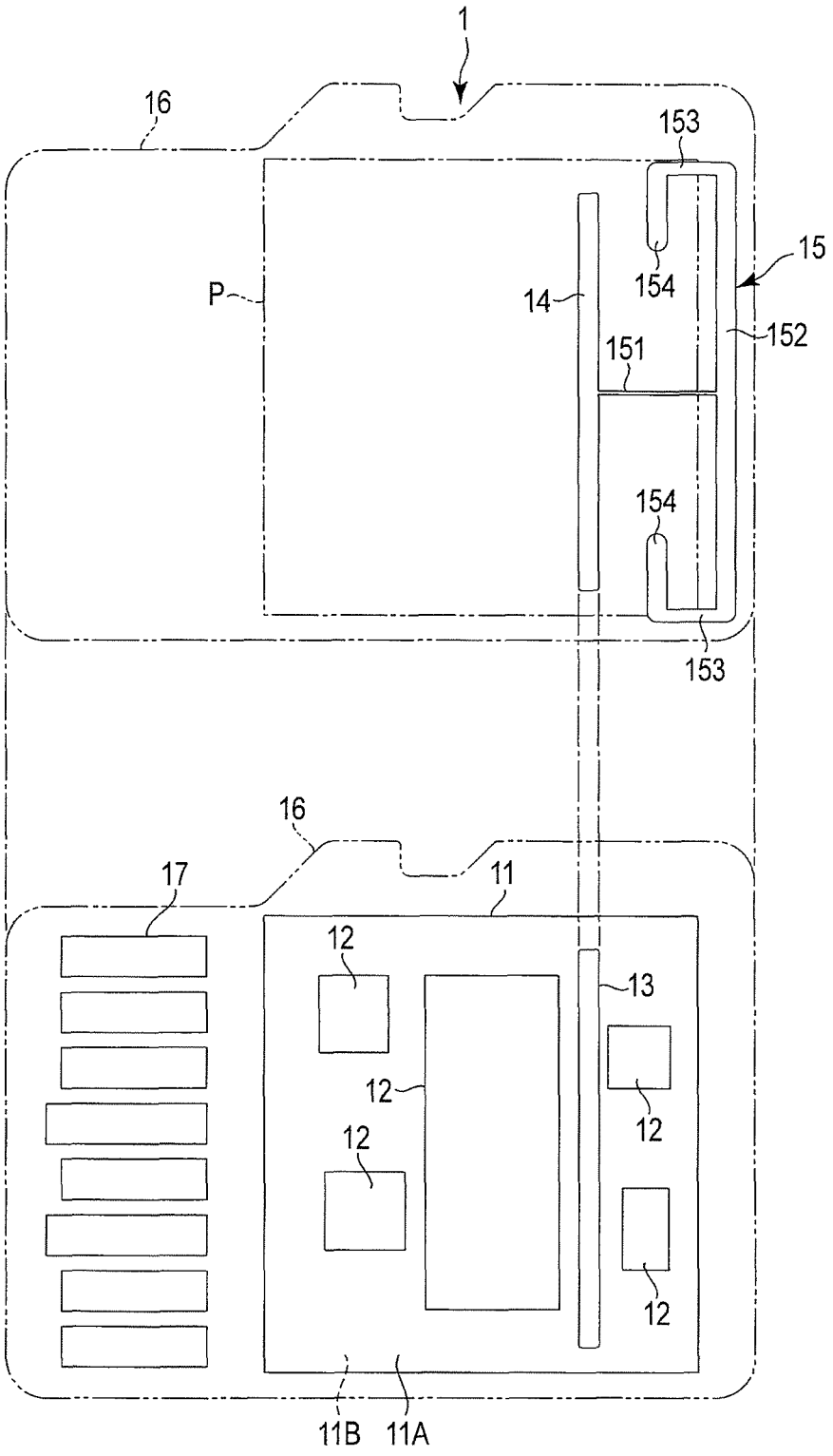
FIG. 3 is a plan view showing arrangement of a first electrode and a second electrode of the radio communication apparatus of FIG. 1.

A radio communication apparatus 1 of the first embodiment will be described with reference to FIGS. 1 to 3. The radio communication apparatus 1 shown in FIG. 1 is manufactured to have the same size as a standardized memory device, for example a micro SD card (registered trademark). The size of the radio communication apparatus 1 is not limited to the size of the micro SD card and may be formed to have a size of, for example, an SD card (registered trademark), a mini SD card (registered trademark), an SIM card mounted in a mobile-phone and a smart-phone, a memory device with another standard, or a memory device smaller than the micro SD card. The radio communication apparatus 1 is inserted into a socket with a corresponding standard, is supplied electric power through an exposed terminal 17, and then signals input and output are performed.

The radio communication apparatus 1 shown in FIG. 1 is provided with a printed-wiring board 11, electronic elements 12, a first electrode 13, a second electrode 14, an antenna 15, and a molded member 16. The printed-wiring board 11 includes a plurality of layers formed with a wiring pattern. The electronic element 12 is mounted on the printed-wiring board 11 and includes at least portion of a communication circuit. The electronic element 12 includes a large-scale integration (LSI), a NAND flash memory, and a frequency-voltage conversion circuit, and so on. In the present embodiment, the electronic elements 12 are mounted on a first surface 11A of the printed-wiring board 11. When a sufficient dimension in the thickness direction of the printed-wiring board 11 can be prepered, the electronic elements 12 may be mounted not only on the first surface 11A of the printed-wiring board 11 but also on a second surface 11B on the opposite side of the first surface 11A.

The first electrode 3 is conductor-connected to the printed-wiring board 11. In this embodiment, the first electrode 13 is provided on the printed-wiring board 11 as shown in FIGS. 1 and 2 and disposed on the first surface 11A mounted with the electronic elements 12 and so on. The second electrode 14 has the same size as the first electrode 13 as shown in FIGS. 1 and 3 and is disposed parallel to the first electrode 13 as shown in FIG. 2. The first electrode 13 and the second electrode 14 are capacitively coupled and can transmit a signal. In FIG. 3, for convenience's sake of explanation, the second electrode 14 and the antenna 15 are shown in a row separately from other components. The components in FIG. 3 are arranged to overlap in the thickness direction of the printed-wiring board 11 as shown in FIGS. 1 and 2.

The antenna 15 is conductor-connected to the second electrode 14. The antenna 15, as shown in FIG. 3, is symmetrically formed about the position where the antenna 15 is conductor-connected to the second electrode 14. The antenna 15 is bent along a plane parallel to the printed-wiring board 11. At least a portion of the antenna 15 extends outer side than a projection region P in the thickness direction of the printed-wiring board 11 as shown in FIGS. 2 and 3. The antenna 15 is provided with a first portion 151, a second portion 152, a third portion 153, and a fourth portion 154.

The first portion 151 is a portion conductor-connected to the second electrode 14. The second portion 152 is disposed substantially parallel to the printed-wiring board 11 and extends in a direction crossing the first portion 151, that is, a direction perpendicular to the first portion 151 in this embodiment. The third portion 153 is disposed substantially parallel to the printed-wiring board 11 and continuously extends from the second portion 152 in a direction crossing the second electrode 14. The fourth portion 154 is substantially parallel to the printed-wiring board 11 and continuously extends in a direction crossing the third portion 153 and from an end of the third portion toward the first portion. In this embodiment, the first portion 151 to the fourth portion 154 are arranged on the same plane, and the first and third portions 151 and 153 and the second and fourth portions 152 and 154 are arranged substantially parallel to each other.

When the frequency of radio communication applied to the radio communication apparatus 1 is represented by $\lambda$ and integer is represented by n, the length of the antenna 15 from the position conductor-connected to the second electrode 14 to the fourth portion 154 being a front end is set to a length $\lambda(2n-1)/4$, for example. The radio communication apparatus 1 performs near field communication, for example radio communication corresponding to the standard of Transfer Jet (registered trademark). When radio communication is corresponded to standards other than Transfer Jet (registered trademark), the antenna 15 is formed to have a length corresponding to the radio communication frequency. The applicable radio communication standard is not limited to Transfer Jet, and Bluetooth (registered trademark) and other communication standards may be applied.

The molded member 16 is formed by injection-molding so as to embed therein the printed-wiring board 11, the electronic elements 12, the first electrode 13, the second electrode 14, and the antenna 15. The molded member 16 is filled in between the first electrode 13 and the second electrode 14 and functions as a dielectric in this portion. The antenna 15 is disposed near the outer surface of the molded member 16. Accordingly, the antenna 15 easily transmits a signal output from the communication circuit. The antenna 15 is connected to the communication circuit on the printed-wiring board 11 by capacitive coupling between the first electrode 13 and the second electrode 14. In order to dispose the antenna 15 near the outer surface of the molded member 16, the second electrode 14 and the antenna 15 are embedded in the molded member 16 by injection-molding before the printed-wiring board 11 and so on, are embedded in the molded member 16, for example. In the manufacturing method and process, the best way is suitably used so that the above constitution and structure are provided, and the manufacturing method and process are not limited to the above ones.

As described above, in the radio communication apparatus 1 with the antenna 15, since the antenna 15 is disposed near the outer surface of the molded member 16, radio waves output from the antenna 15 does not affect the electronic elements 12 on the printed-wiring board 11 and is less likely to be affected. Namely, in the radio communication apparatus 1, the qualities of radio waves are good, and communication sensitivity with a radio communication apparatus as a communication counterpart is improved. Since the antenna 15 is disposed at a position not on the printed-wiring board 11 in the molded member 16, the size of the antenna 15 and the effective cross-sectional area as the antenna 15 are not limited by the region of the printed-wiring board 11 and the arrangement of the electronic elements 12, and the antenna 15 can be formed to have any shape within a range of the molded member 16. Further, in the radio communication apparatus 1 of this embodiment, the first electrode 13 and the second electrode 14 are capacitively coupled. Accordingly, while an AC coupling is required to be incorporated into an output port of an electronic element constituting a conventional communication circuit, in the radio communication apparatus 1 of this embodiment the AC coupling is not required.

Hereinafter, the radio communication apparatuses 1 of the second to seventh embodiments will be described. In the radio communication apparatuses 1 of the second to seventh embodiments, the elements of the radio communication apparatuses 1 of the second to seventh embodiments having the same functions as the communication device 1 of the first embodiment are assigned the same reference numerals and symbols as those of the first embodiment. The detailed descriptions of these elements should be referred to accompanying descriptions of the same numerals and symbols in the first embodiment. The radio communication apparatuses 1 of the second to seventh embodiments are different from the radio communication apparatus 1 of the first embodiment in the arrangement and shape of the first electrode 13 and the second electrode 14 and the shape and arrangement of the antenna 15.

Figure 4:
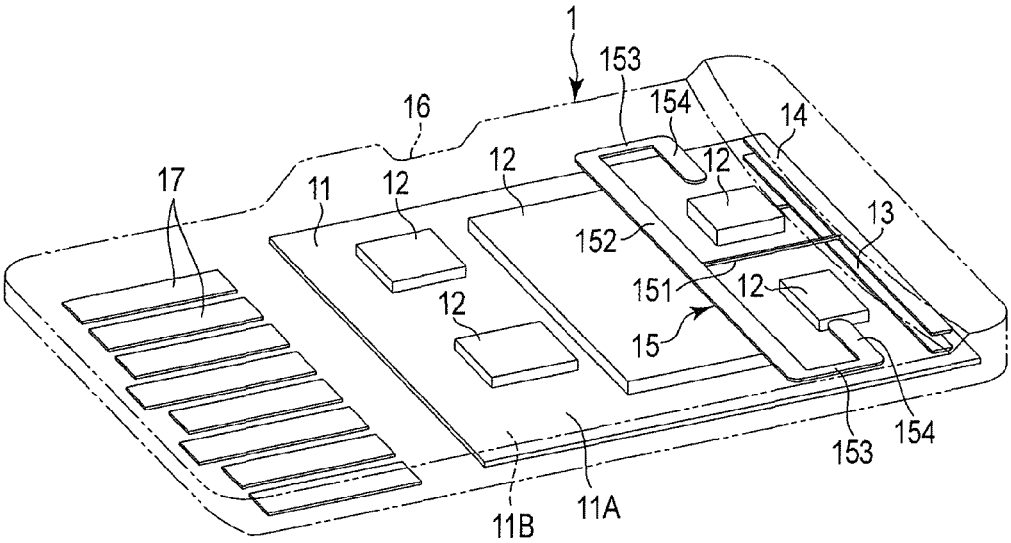
FIG. 4 is a perspective view of a radio communication apparatus of a second embodiment.
Figure 5:
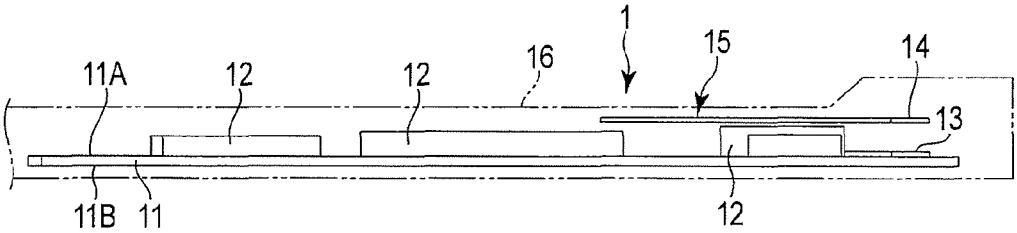
FIG. 5 is a cross-sectional view of the radio communication apparatus of FIG. 4.
Figure 6:
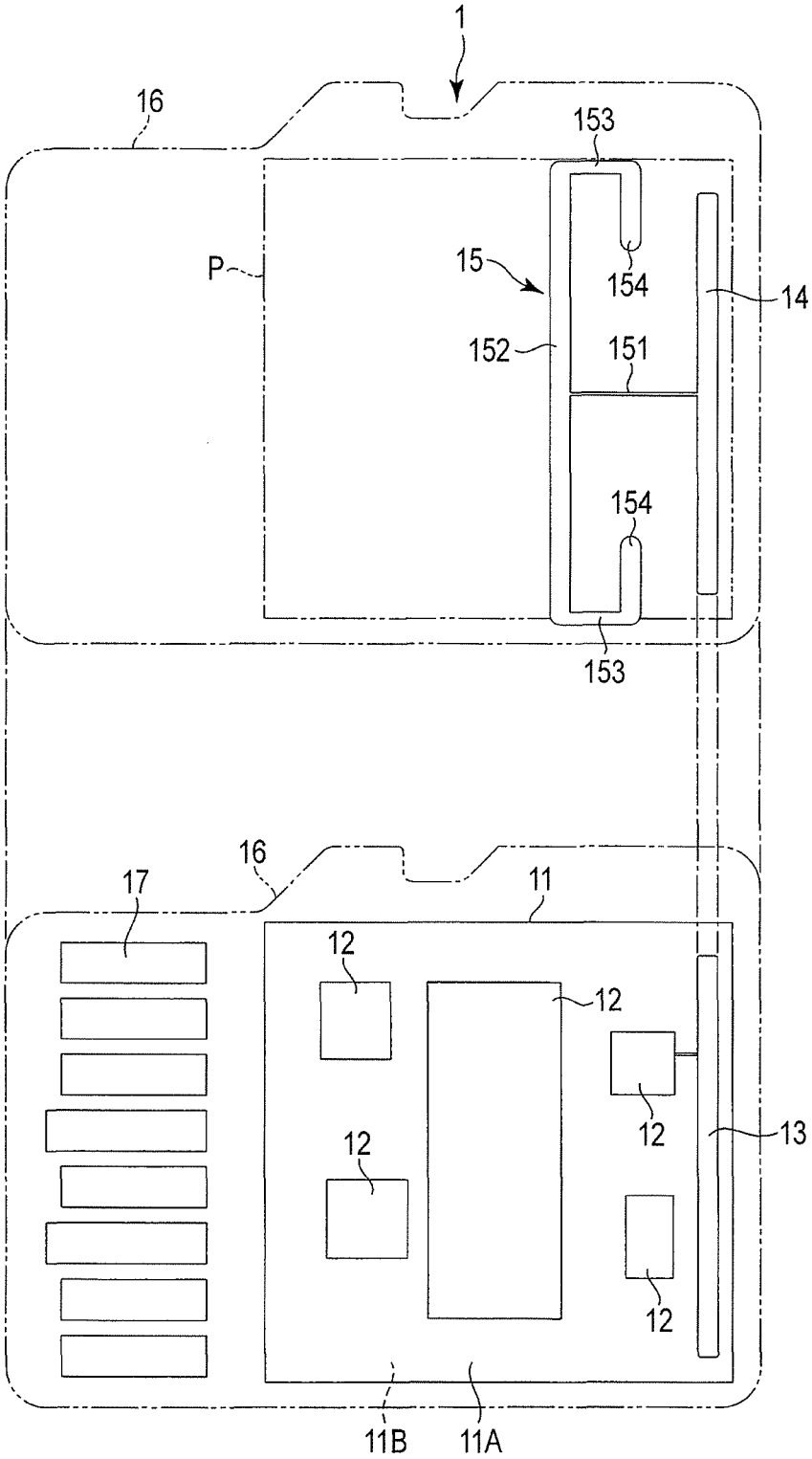
FIG. 6 is a plan view showing arrangement of a first electrode and a second electrode of the radio communication apparatus of FIG. 4.

The radio communication apparatus 1 of the second embodiment will be described with reference to FIGS. 4 to 6. In the radio communication apparatus 1 shown in FIG. 4, a first electrode 13 is provided at an edge of a printed-wiring board 11 near an outer peripheral portion of a molded member 16. Accompanying this, a second electrode 14 is also disposed at the outer peripheral portion of the molded member 16, and an antenna 15 expands to the side overlapping with the printed-wiring board 11 in the thickness direction of the printed-wiring board 11. The shape of the antenna 15 of the radio communication apparatus 1 in the second embodiment is the same as the shape of the antenna 15 in the first embodiment as shown in FIGS. 4 and 6, and the direction of disposing the antenna is different from that in the first embodiment. As shown in FIG. 5, since the antenna 15 is not provided on the printed-wiring board 11, the antenna 15 can be disposed so that a portion of the antenna 15 is overlapped with the electronic element 12 mounted on the printed-wiring board 11. Namely, the antenna 15 can be formed to have an ideal shape within the range of the molded member 16 without an influence from the area of the printed-wiring board 11 and the arrangement of the electronic elements 12.

Figure 7:
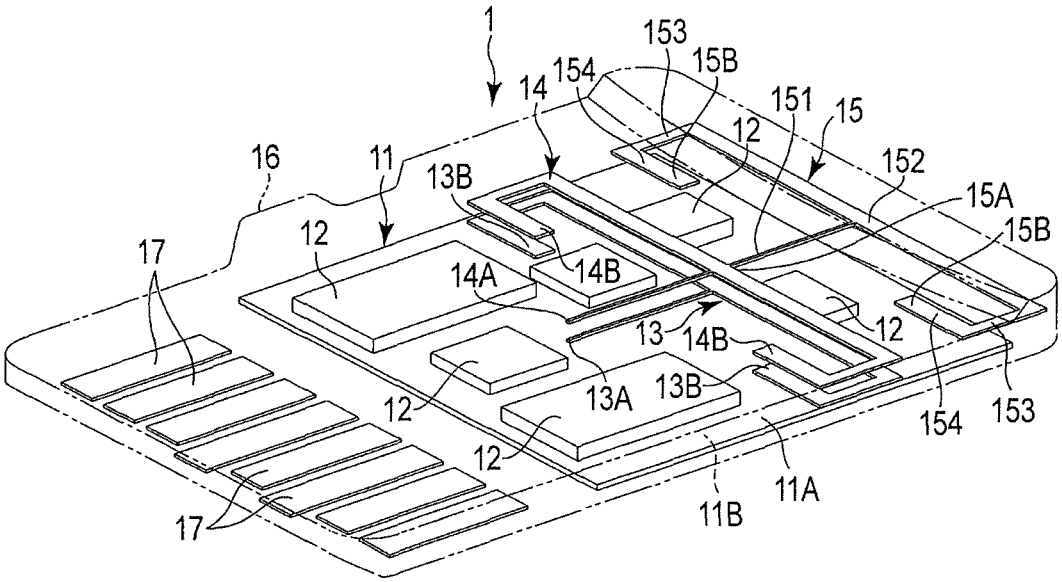
FIG. 7 is a perspective view of a radio communication apparatus of a third embodiment.
Figure 8:
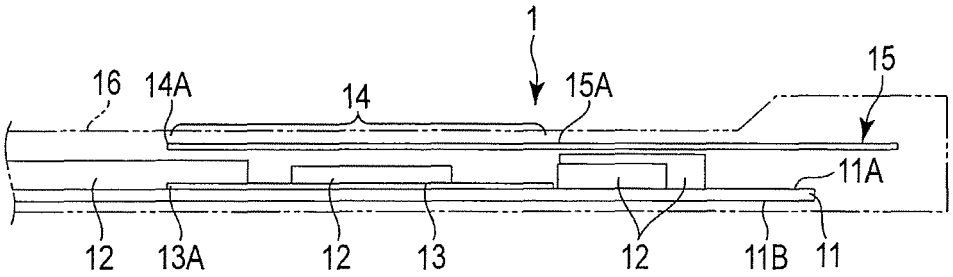
FIG. 8 is a cross-sectional view of the radio communication apparatus of FIG. 7.
Figure 9:
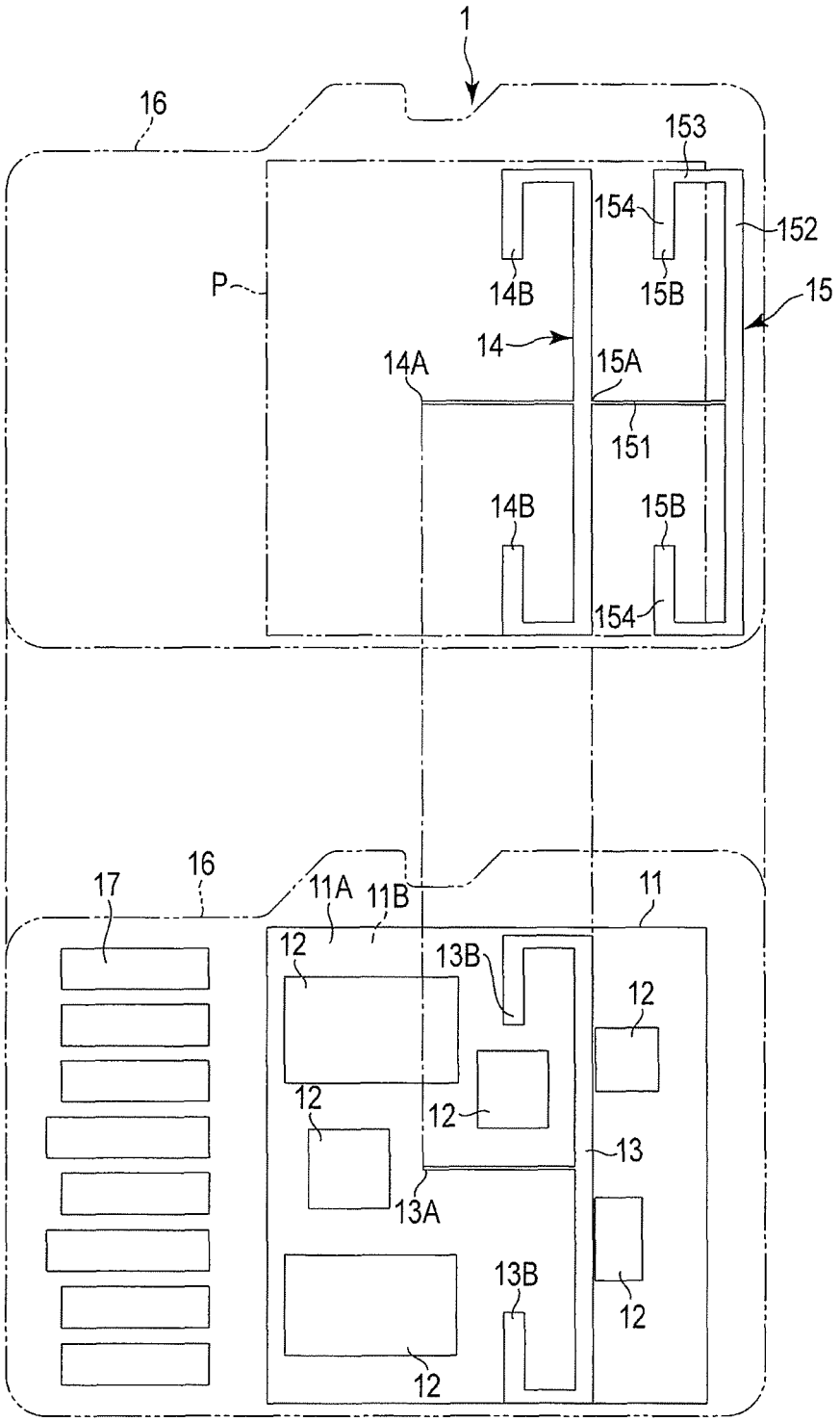
FIG. 9 is a plan view showing arrangement of a first electrode and a second electrode of the radio communication apparatus of FIG. 7.

The radio communication apparatus 1 of the third embodiment will be described with reference to FIGS. 7 to 9. In the radio communication apparatus 1 shown in FIG. 7, as shown in FIGS. 7 and 9, an antenna 15 includes a first portion 151, a second portion 152, and a third portion 153. The length of a first electrode 13 from a base 13A conductor-connected to a communication circuit from symmetrically extending ends 13B is the same as the length from a base 15A conductor-connected to a second electrode 14 to symmetrically extending ends 15B. Since the second electrode 14 is formed to have the same shape as the first electrode 13, the length from a base 14A of the second electrode 14 to ends 14B is the same as the length of the antenna 15. In the third embodiment, as shown in FIG. 9, the first and second electrodes 13 and 14 have the same shape as the antenna 15.

The antenna 15 is formed to have such a shape that the passage characteristic in a radio band is maximum. Since the shapes of the first and second electrodes 13 and 14 are the same as the shape of the antenna 15, the passage characteristics between a printed-wiring board 11 and a molded member 16 is maximum. A signal is easily resonated and efficiently transmitted between the first electrode 13 and the second electrode 14 conductor-connected to each other and between the second electrode 14 and the antenna 15, and the performance of wireless transmission and reception as the radio communication apparatus 1 is enhanced.

Figure 10:
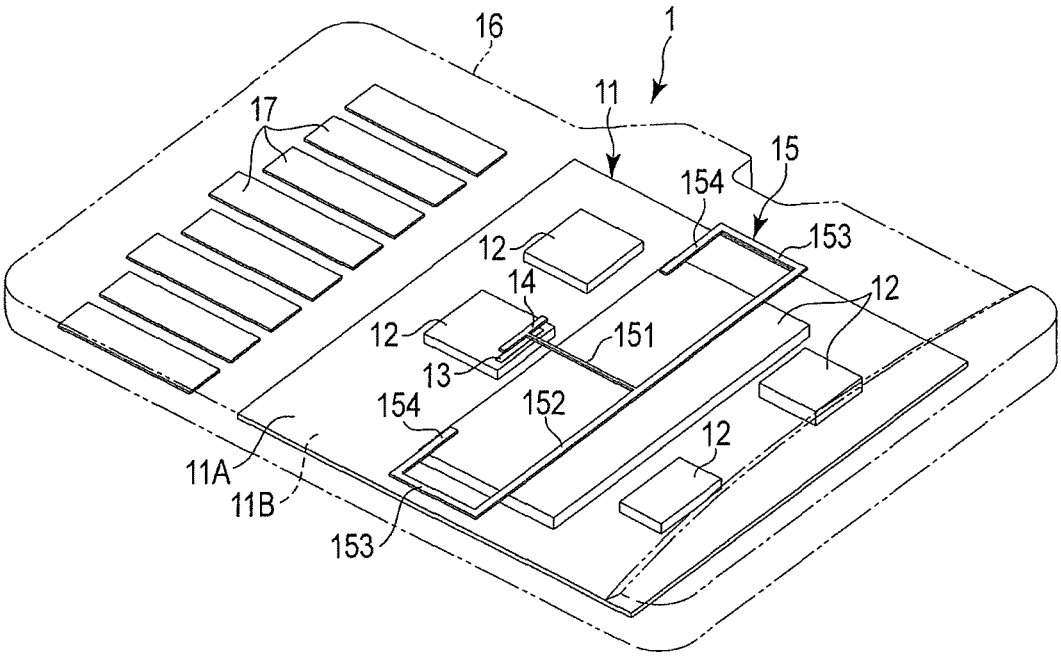
FIG. 10 is a perspective view of a radio communication apparatus of a fourth embodiment.
Figure 11:
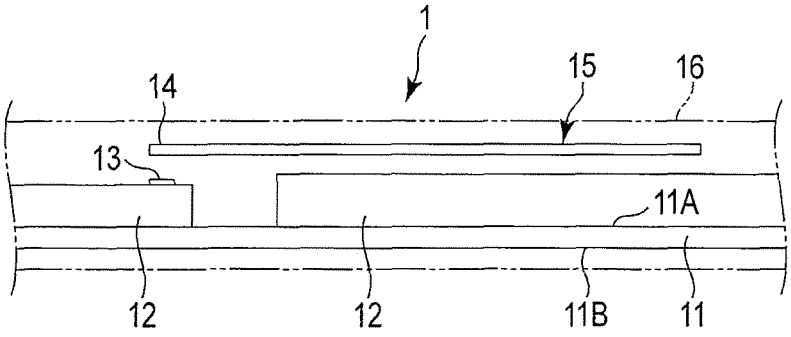
FIG. 11 is a cross-sectional view of the radio communication apparatus of FIG. 10.

The radio communication apparatus 1 of the fourth embodiment will be described with reference to FIGS. 10 to 12. In the radio communication apparatus 1 shown in FIG. 10, a first electrode 13 is disposed on the outer surface of an electronic element 12 mounted on a printed-wiring board 11. In the fourth embodiment, the first electrode 13 is formed on the outer surface on the opposite side of a surface connected to the printed-wiring board 11, as shown in FIG. 11. The first electrode 13 and a second electrode 14 in the fourth embodiment are arranged along a direction crossing a first portion 151 of an antenna 15, and in this embodiment, the direction perpendicular to the first portion 151.

Figure 12:
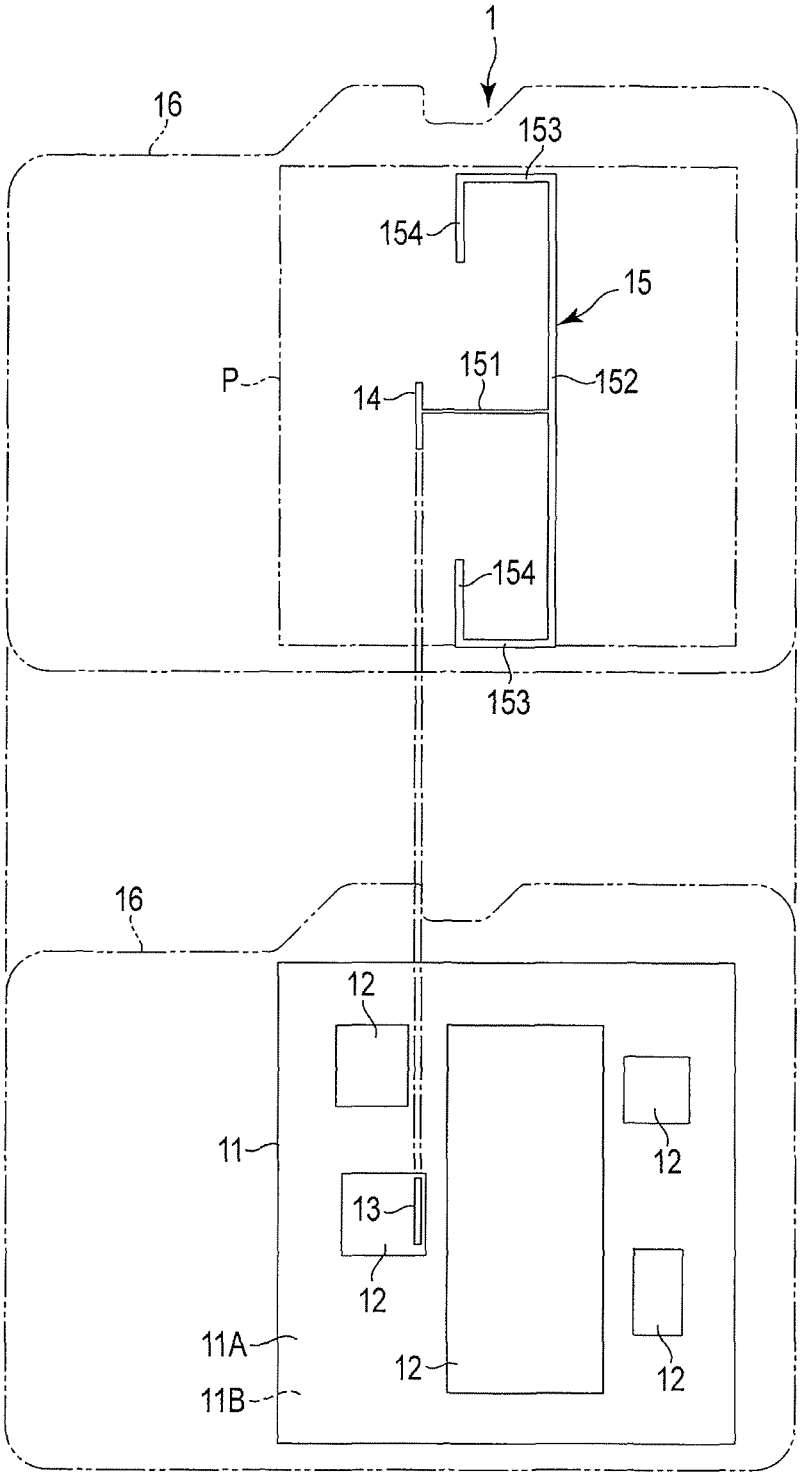
FIG. 12 is a plan view showing arrangement of a first electrode and a second electrode of the radio communication apparatus of FIG. 10.

The size of the first and second electrodes 13 and 14 is limited by the size of the electronic element 12 disposed with the first electrode 13, as shown in FIG. 12. However, as shown in FIG. 11, the distance between the first electrode 13 and the second electrode 14 is closer than the distance in comparison with the case where the first electrode 13 is disposed on the printed-wiring board 11. Since the first electrode 13 and the second electrode 14 are capacitively coupled to each other, the area required as an electrode may be decreased as the distance between the first electrode 13 and the second electrode 14 is decreased. Since the first electrode 13 is not disposed on the printed-wiring board 11, the electronic elements 12 and wiring can be efficiently arranged.

Figure 13:
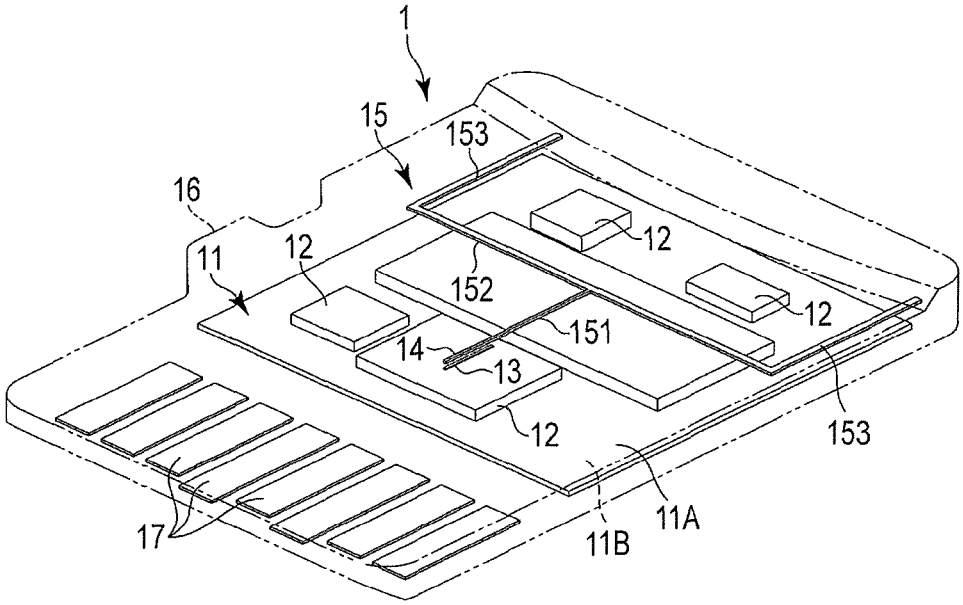
FIG. 13 is a perspective view of a radio communication apparatus of a fifth embodiment.
Figure 14:
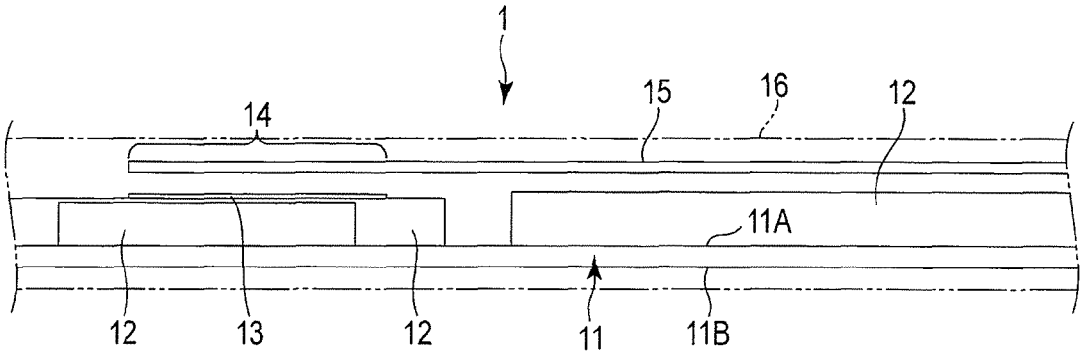
FIG. 14 is a cross-sectional view of the radio communication apparatus of FIG. 13.
Figure 15:
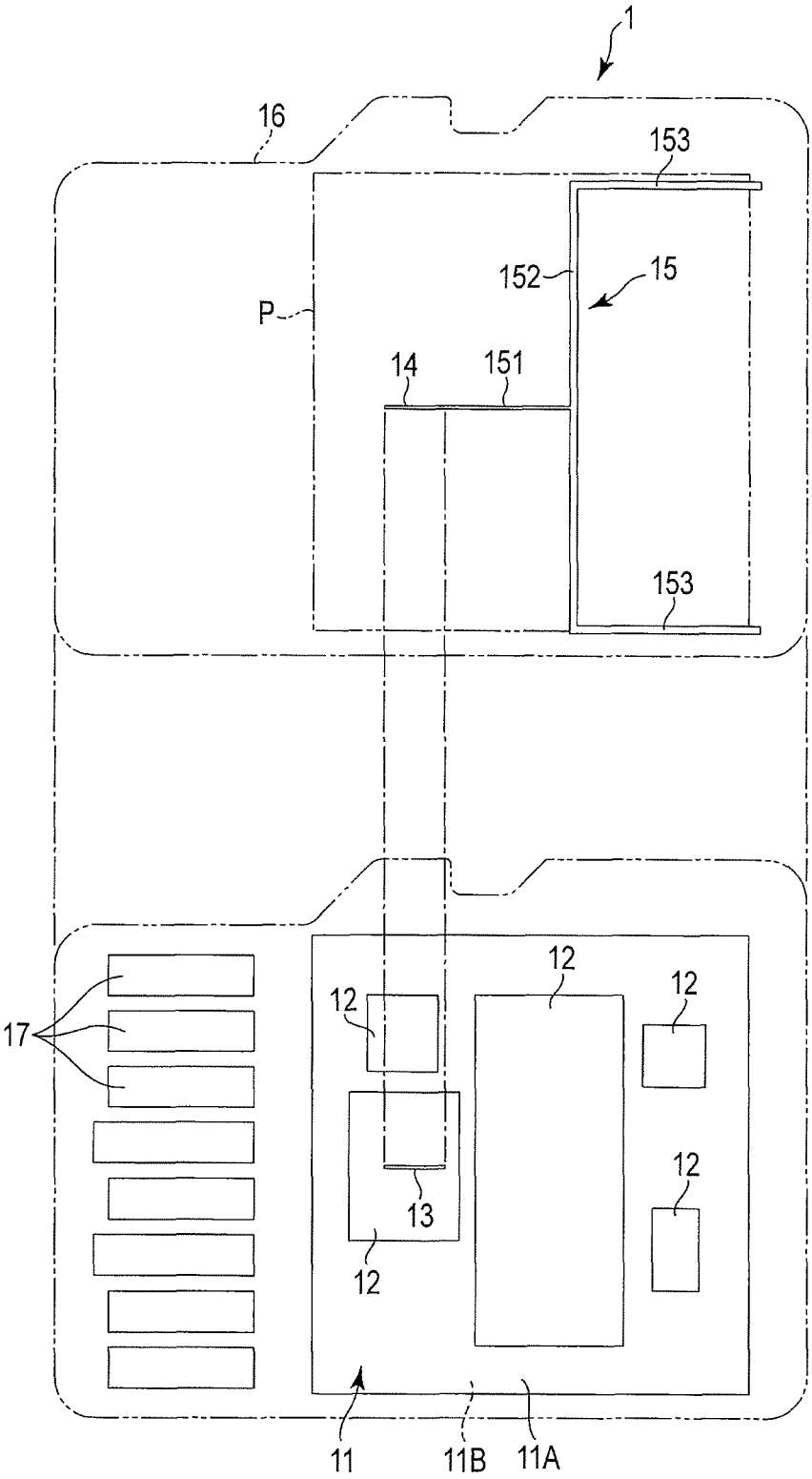
FIG. 15 is a plan view showing arrangement of a first electrode and a second electrode of the radio communication apparatus of FIG. 13.

The radio communication apparatus 1 of the fifth embodiment will be described with reference to FIGS. 13 to 15. In the radio communication apparatus 1 shown in FIG. 13, a first electrode 13 is disposed on the outer surface of an electronic element 12 as in the fourth embodiment. The first electrode 13 and a second electrode 14 in the fifth embodiment are arranged in a direction along a first portion 151 of an antenna 15. In this case, the second electrode 14 is located on an extension of the first portion 151 of the antenna 15.

In this embodiment, the antenna 15 includes the first portion 151, a second portion 152, and a third portion 153. Although the antenna 15 does not have a fourth portion 154, the antenna 15 is formed so that the total length of the first portion 151, the second portion 152, and the third portion 153 is the length adapted to the frequency in the radio band to which the radio communication apparatus 1 is applied. Since the first electrode 13 is disposed on the outer surface of the electronic element 12, the distance between the first electrode 13 and the second electrode 14 is small as shown in FIG. 14. As shown in FIGS. 13 and 15, it is possible to reduce an area of a portion where the first electrode 13 and the second electrode 14 capacitively coupled to face each other.

The radio communication apparatus 1 of the sixth embodiment will be described with reference to FIGS. 16 to 18. In the radio communication apparatus 1 shown in FIG. 16, as in the first to third embodiments, a first electrode 13 is formed on a first surface 11A of a printed-wiring board 11. Although the shapes of the first electrode 13 and a second electrode 14 are different from the shape of an antenna 15, the first electrode 13 and the second electrode 14 are formed so that the length from a base 13A to an end 13B of the first electrode 13 and the length from a base 14A to an end 14B of the second electrode 14 are the same as the length from a base 15A to an end 15B of the antenna 15.

Figure 16:
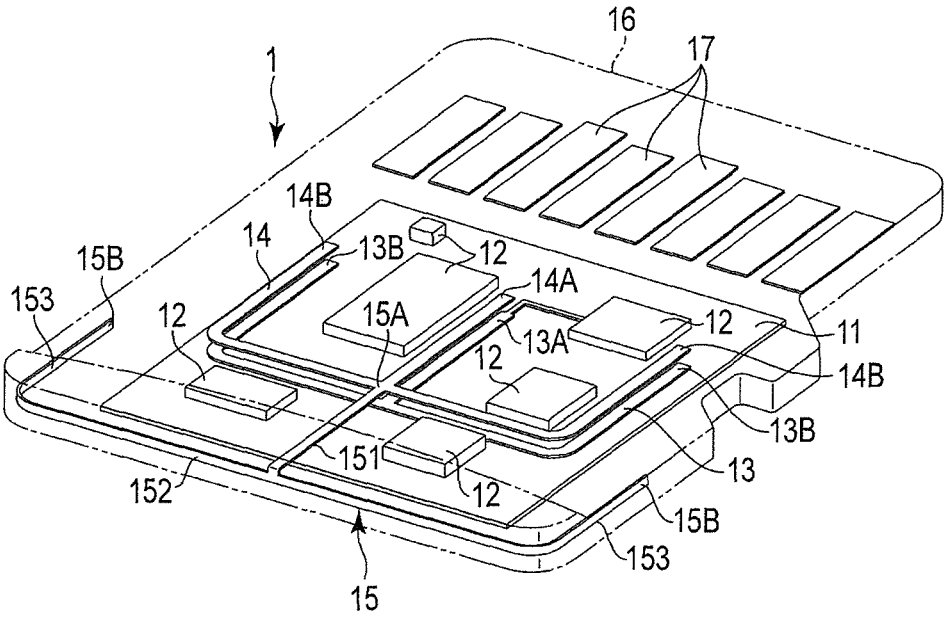
FIG. 16 is a perspective view of a radio communication apparatus of a sixth embodiment.
Figure 17:
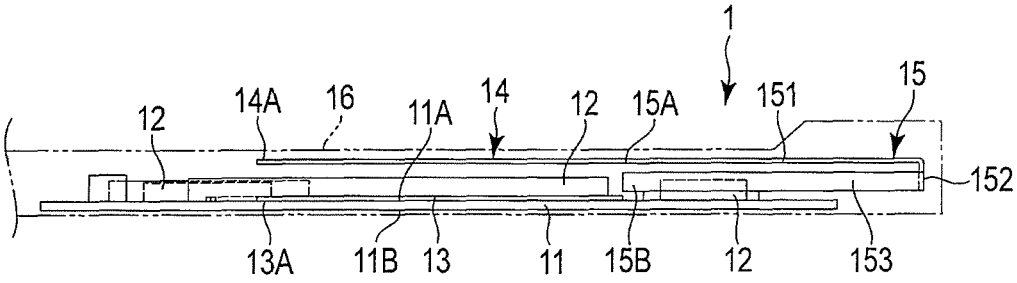
FIG. 17 is a cross-sectional view of the radio communication apparatus of FIG. 16.
Figure 18:
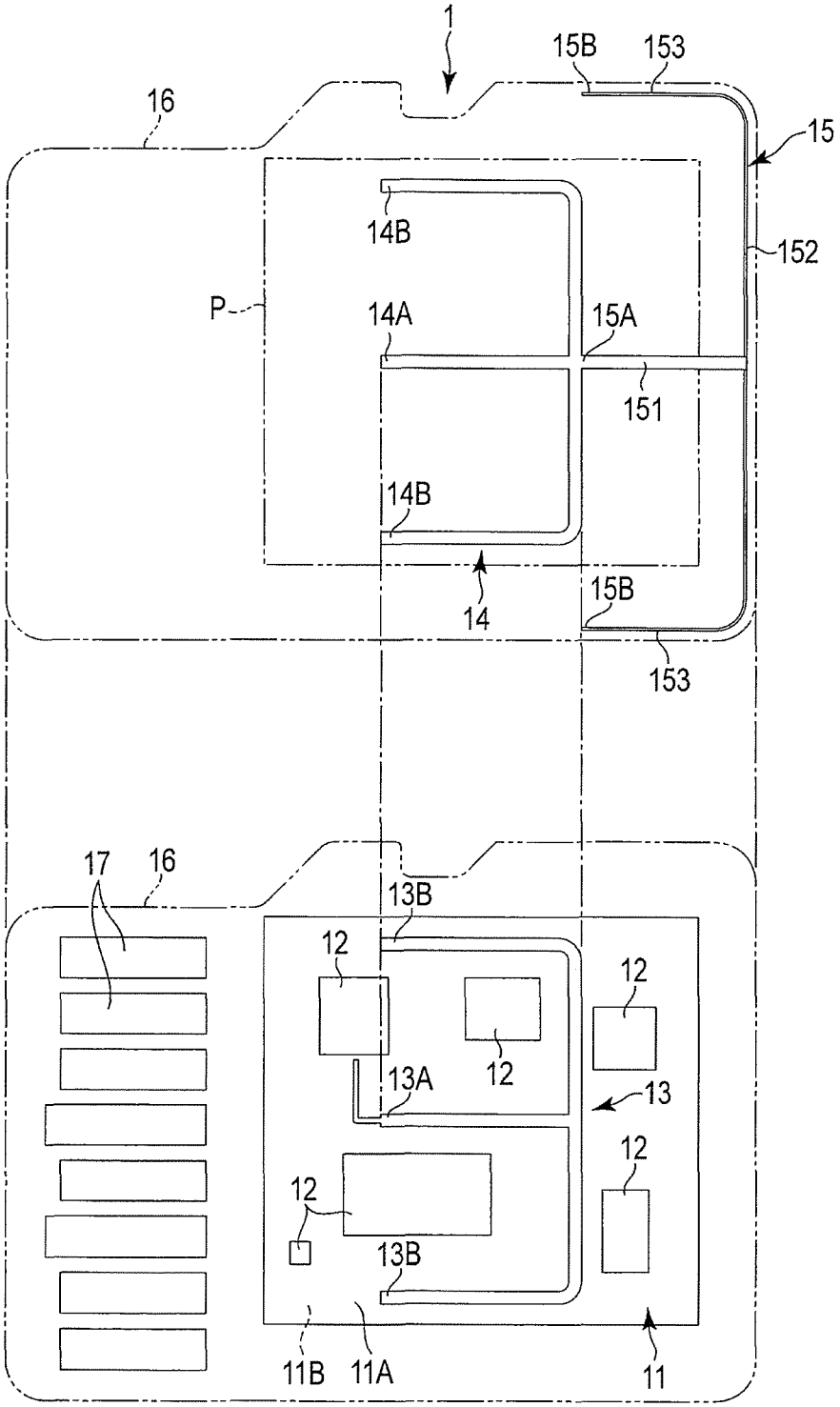
FIG. 18 is a plan view showing arrangement of a first electrode and a second electrode of the radio communication apparatus of FIG. 16.

As shown in FIGS. 16 and 18, a second portion 152 and a third portion 153 of the antenna 15 are arranged along an outer peripheral wall 161 of a molded member 16 formed along a thickness direction of the printed-wiring board 11. In the sixth embodiment, as shown in FIGS. 16 and 17, the second portion 152 and the third portion 153 of the antenna 15 are arranged at a position closer to the printed-wiring board 11 in the thickness direction of the printed-wiring board 11 than the first portion 151.

The antenna 15 is disposed near an outer surface of the molded member 16 and, in this embodiment, along the outer peripheral wall 161. In the second portion 152 and the third portion 153 of the antenna 15 shown in FIGS. 16 and 17, the dimension along the thickness direction of the printed-wiring board 11 is larger than the dimension in a direction along the first surface 11A of the printed-wiring board 11. The entire second and third portions 152 and 153 of the antenna 15 are arranged outside a projection region P in the thickness direction of the printed-wiring board 11. When a radio communication apparatus of another electronic equipment as a communication counterpart is disposed adjacent to the outer peripheral wall 161, the communication sensitivity of the radio communication apparatus 1 of the sixth embodiment is further enhanced compared to the first to fifth embodiments.

Figure 19:
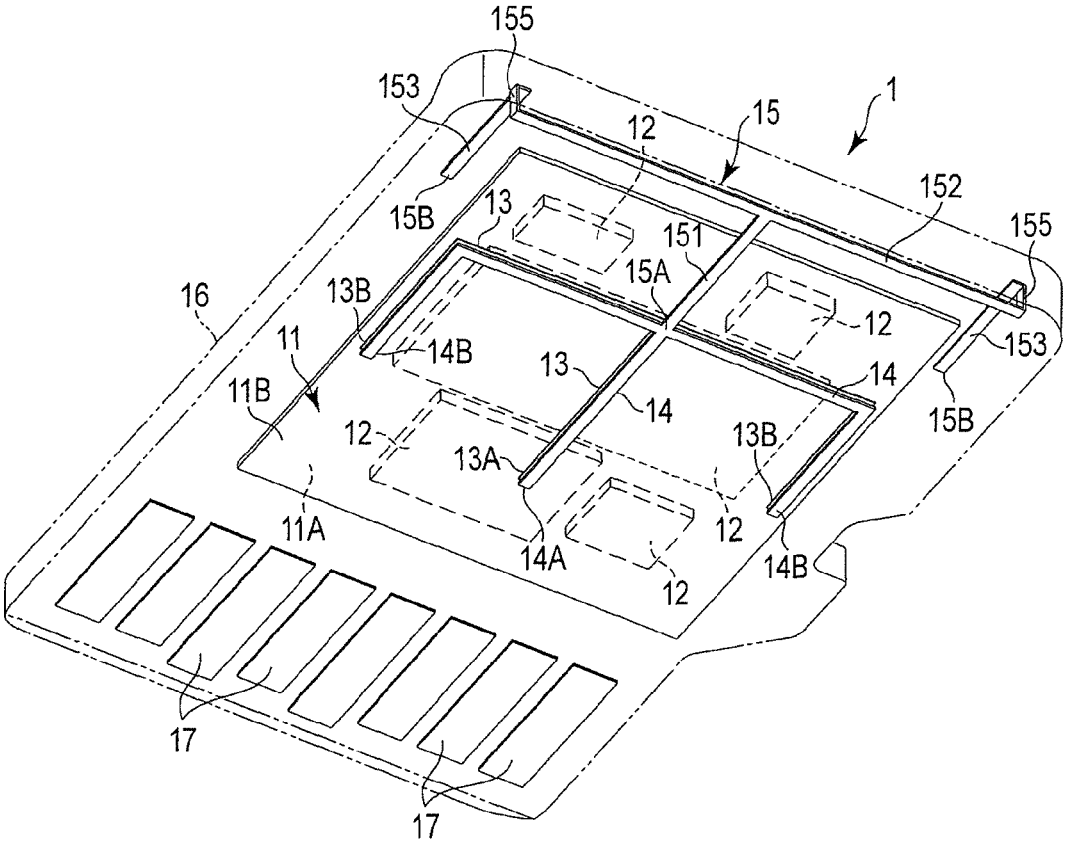
FIG. 19 is a perspective view of a radio communication apparatus of a seventh embodiment.

The radio communication apparatus 1 of the seventh embodiment will be described with reference to FIGS. 19 to 21. FIGS. 19 and 21 show the radio communication apparatus 1 as viewed from a second surface 11B side of a printed-wiring board 11. In the radio communication apparatus 1 shown in FIG. 19, although a first electrode 13 is disposed on the printed-wiring board 11 as in the radio communication apparatus 1 of the first to third and sixth embodiments, the first electrode 13 is formed on the second surface 11B of the printed-wiring board 11, unlike the above embodiments. A second electrode 14 is disposed to face the second surface 11B of the printed-wiring board 11, and, thus, to face the first electrode 13. The first electrode 13 is connected to an output port of the electronic element 12 included in a communication circuit mounted on a first surface 11A side of the printed-wiring board 11 via a through hole or the like.

The antenna 15 includes a first portion 151, a second portion 152, a third portion 153, and a connection portion 155. The first portion 151 extends outer side than a projection region P in a thickness direction of the printed-wiring board 11. Accordingly, as shown in FIGS. 19 and 21, the second portion 152 and the third portion 153 are arranged outside the projection region P in the thickness direction of the printed-wiring board 11.

Figure 20:
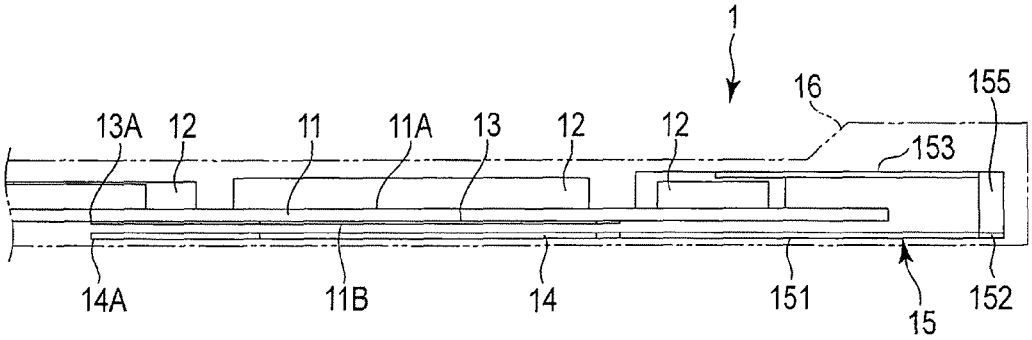
FIG. 20 is a cross-sectional view of the radio communication apparatus of FIG. 19.
Figure 21:
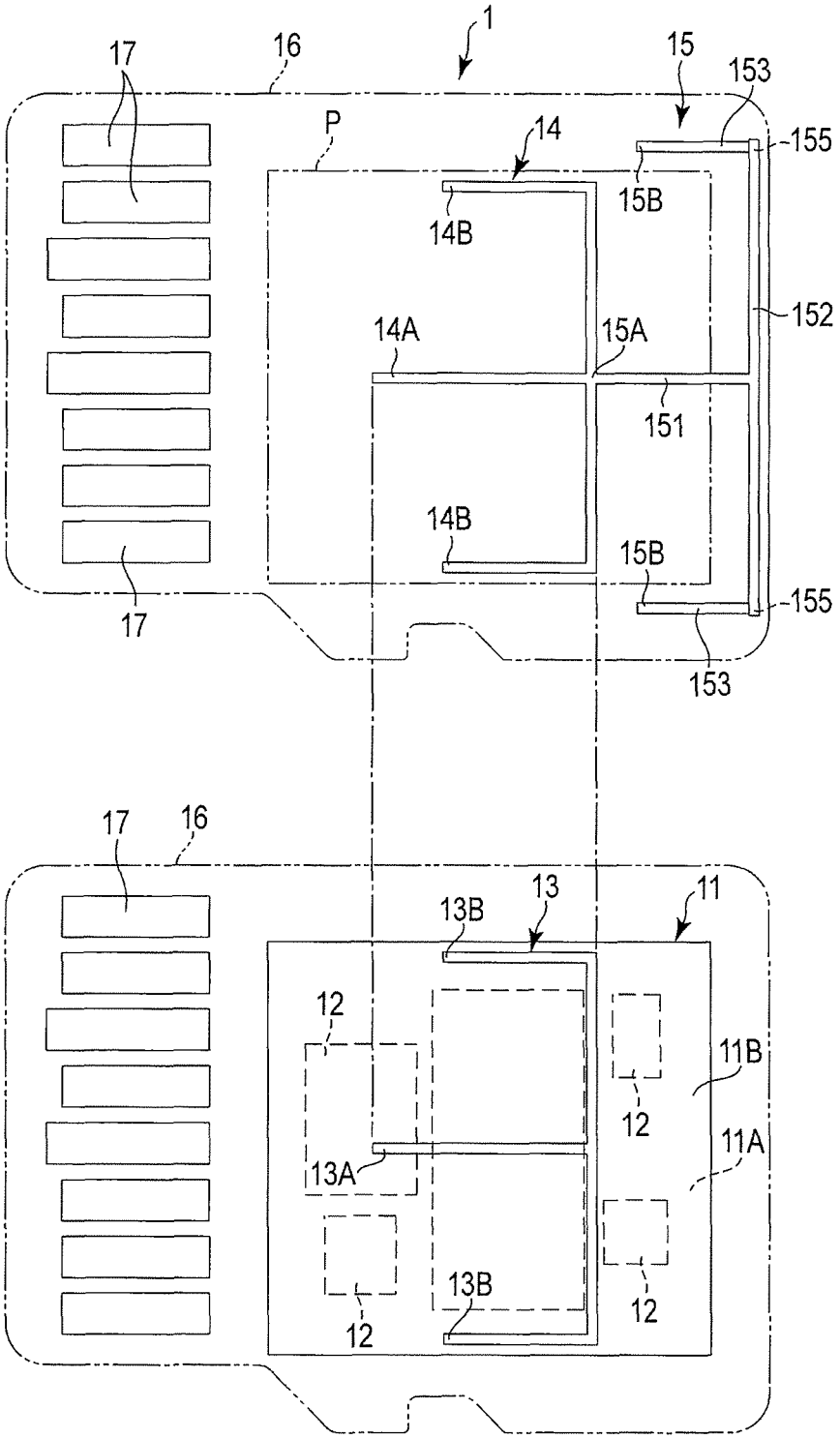
FIG. 21 is a plan view showing arrangement of a first electrode and a second electrode of the radio communication apparatus of FIG. 19.

As shown in FIGS. 19 and 20, the connection portion 155 connects the second portion 152 and the third portion 153 so that they are continued in the thickness direction of the printed-wiring board 11. While the second portion 152 is located on the second surface 11B side of the printed-wiring board 11, the third portion 153 is located on the first surface 11A side of the printed-wiring board 11 by the connection portion 155. The connection portion 155 may be provided between the first portion 151 and the second portion 152, and both the second portion 152 and the third portion 153 may be arranged on the first surface 11A side of the printed-wiring board 11.

As in the third and sixth embodiments, the length of the second electrode 14 from the position where the second electrode 14 is conductor-connected to the communication circuit to symmetrically extending ends is the same as the length of the antenna from the position where the antenna is conductor-connected to the second electrode 14 to symmetrically extending ends. According to this constitution, the radio communication apparatus 1 in the seventh embodiment obtains a similar effect to that of the radio communication devises 1 in the third and sixth embodiments.

In the radio communication apparatus 1 in the seventh embodiment, the first electrode 13 is disposed on the second surface 11B of the printed-wiring board 11 not mounted with the electronic elements 12. Hence, the first electrode 13 can be disposed freely without competing with the electronic element 12 constituting the communication circuit and the arrangement of the wiring. Since the electronic element 12 is not provided around the first electrode 13, the first electrode 13 and the second electrode 14 can be arranged into close together. Consequently, the communication function in a capacitive coupling between the first electrode 13 and the second electrode 14 is stabilized.

In the seventh embodiment, while the third portion 153 of the antenna 15 is disposed on the first surface 11A of the printed-wiring board 11 by the connection portion 155, as in the first to fifth embodiments, the first portion 151 to the third portion 153 of the antenna 15 may be formed on the same plane and be disposed on the second surface 11B of the printed-wiring board 11.

As described above, in the first to seventh embodiments, the antenna 15 is located on the opposite side of a terminal 17 exposed from the molded member 16 of the radio communication apparatus 1. However, in any embodiment, the position where the antenna 15 is disposed is not limited to the positions shown in each drawing. The first electrode 13, the second electrode 14, and the antenna 15 shown in FIGS. 3, 6, 9, 12, 15, 18, and 21 may be arranged to be rotated by 90° clockwise or counterclockwise from the outer shape of the molded member 16 in each drawing. The antenna 15 is sometimes called as "coupler" when the radio communication apparatus 1 is used in near field communication such as Transfer Jet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A radio communication apparatus comprising:

a printed-wiring board;

an electronic element on the printed-wiring board constituting at least a portion of a communication circuit;

a first electrode conductor-connected to the printed-wiring board;

a second electrode having the same size as the first electrode, disposed parallel to the first electrode, and capacitively coupled to the first electrode, wherein the first electrode is disposed between the second electrode and the printed-wiring board, and wherein a distance is provided between the first and second electrode;

an antenna conductor-connected to the second electrode; and a molded member burying the printed-wiring board, the electronic element, the first electrode, the second electrode, and the antenna, the molded member formed by injection-molding and arranging the antenna near the outer surface, wherein the molded member fills in an area between the first electrode and the second electrode and functions as a dielectric in the area.

2. The radio communication apparatus of claim 1, wherein the antenna has a symmetrical structure about a position where the antenna is conductor-connected to the second electrode.

3. The radio communication apparatus of claim 2, wherein the antenna is bent along a plane parallel to the printed-wiring board.

4. The radio communication apparatus of claim 3, wherein the antenna comprises at least a portion extending outer side than a projection region in a thickness direction of the printed-wiring board.

5. The radio communication apparatus of claim 3, wherein the antenna comprises a first portion conductive-connected to the second electrode; and a second portion parallel to the printed-wiring board and extending in a direction crossing the first portion.

6. The radio communication apparatus of claim 5, wherein the antenna comprises a third portion parallel to the printed-wiring board and extending continuously from the second portion in a direction crossing the second portion.

7. The radio communication apparatus of claim 6, wherein the antenna comprises a connection portion connecting the second portion and the third portion in the thickness direction of the printed-wiring board.

8. The radio communication apparatus of claim 6, wherein the second portion and the third portion are arranged along an outer peripheral wall of the molded member formed in the thickness direction of the printed-wiring board.

9. The radio communication apparatus of claim 3, wherein the first electrode is disposed on the printed-wiring board.

10. The radio communication apparatus of claim 9, wherein the electronic element is mounted on a first surface of the printed-wiring board, and the first electrode is disposed on the first surface.

11. The radio communication apparatus of claim 9, wherein the electronic element is mounted on a first surface of the printed-wiring board, and the first electrode is disposed on a second surface of the printed-wiring board on the opposite side of the first surface.

12. The radio communication apparatus of claim 3, wherein the first electrode is disposed on an outer surface of the electronic element on the opposite side of the printed-wiring board.

13. The radio communication apparatus of claim 3, wherein the length of the first electrode from a base conductive-connected to the communication circuit to symmetrically extending ends is the same as the length of the antenna from a base conductive-connected to the second electrode to symmetrically extending ends.

14. The radio communication apparatus of claim 13, wherein the second electrode has the same shape as the antenna.

* * * * *